US011673242B2

(12) United States Patent
Nagel, III et al.

(10) Patent No.: US 11,673,242 B2
(45) **Date of Patent: *Jun. 13, 2023**

(54) FASTENER DEVICE WITH CAM ASSEMBLY

(71) Applicant: SHUR-A-TAK TECHNOLOGIES LLC, Seville, OH (US)

(72) Inventors: Walter Heinrich Nagel, III, Seville, OH (US); Michael Pintz, Fairview Park, OH (US); Michael Keller, Tallmadge, OH (US); Andrew Somrack, Newbury, OH (US)

(73) Assignee: SHUR-A-TAK TECHNOLOGIES LLC, Seville, OH (US)

( * ) Notice: Subject to any disclaimer, the term of this patent is extended or adjusted under 35 U.S.C. 154(b) by 241 days.

This patent is subject to a terminal disclaimer.

(21) Appl. No.: 17/068,227

(22) Filed: Oct. 12, 2020

(65) Prior Publication Data

US 2021/0023684 A1 Jan. 28, 2021

Related U.S. Application Data

(63) Continuation of application No. 15/910,960, filed on Mar. 2, 2018, now Pat. No. 10,828,755.

(60) Provisional application No. 62/466,153, filed on Mar. 2, 2017.

(51) Int. Cl.

| | |
|---|---|
| ***B25B 23/10*** | (2006.01) |
| ***B25B 23/00*** | (2006.01) |
| ***B25B 21/00*** | (2006.01) |

(52) U.S. Cl.

CPC ..... *B25B 23/105* (2013.01); *B25B 21/00* (2013.01); *B25B 23/0035* (2013.01); *B25B 23/0064* (2013.01)

(58) Field of Classification Search

CPC ..... B25B 23/105; B25B 23/0035; B25B 23/0064; B25B 21/00

See application file for complete search history.

(56) References Cited

U.S. PATENT DOCUMENTS

| | | | |
|---|---|---|---|
| 3,965,950 | A | 6/1976 | MacDonald |
| 4,140,161 | A | 2/1979 | Russo et al. |
| 4,237,946 | A | 12/1980 | Leitner |
| 5,207,127 | A | 5/1993 | Nick |
| 5,509,330 | A | 4/1996 | Nick |
| 5,996,452 | A | 12/1999 | Chiang |
| 6,314,845 | B1 | 11/2001 | Wu |
| 8,893,586 | B2 | 11/2014 | Nagel, III |
| 8,893,594 | B2 | 11/2014 | Nagel, III |

(Continued)

*Primary Examiner* — David B. Thomas

(74) *Attorney, Agent, or Firm* — FisherBroyles, LLP; Clifton E. McCann

(57) ABSTRACT

A fastener device is disclosed. The fastener device includes a hub defining a bore, an attachment shank including a proximal stop and distal bit received within the bore, a retainer releasably engagable with a proximal end of the hub and a defining a passageway for a proximal mounting end of the attachment shank, a biasing element engaged with the proximal stop, and a split cam assembly disposed within a distal end of the bore. The split cam assembly is biased toward a closed configuration for engaging and retaining the head of a fastener, and is piovtable upon distal advancement of the attachment shank and distal bit, against the head, to release the head from engagement with the split cam assembly.

17 Claims, 8 Drawing Sheets

(56) References Cited

U.S. PATENT DOCUMENTS

| | | | | |
|---|---|---|---|---|
| 9,174,285 | B2 | 11/2015 | Chang | |
| 10,828,755 | B2 * | 11/2020 | Nagel, III | B25B 21/00 |

* cited by examiner

FASTENER DEVICE WITH CAM ASSEMBLY

This application is a continuation of prior U.S. patent application Ser. No. 15/910,960, filed Mar. 2, 2018, the entirety of which is hereby incorporated by reference. This application claims the benefit of U.S. Provisional Application No. 62/466,153, filed on Mar. 2, 2017, the entirety of which is hereby incorporated by reference.

TECHNICAL FIELD

The present disclosure relates generally to a fastener device, and more particularly to a fastener device for attachment to a drive tool, where the fastener device includes a cam assembly for selectively retaining a fastener.

BACKGROUND

During construction of a building, surface materials such as drywall may be installed over framing using screws. The screws may be driven into the drywall by an electrically powered drive tool such as a drill. It is to be appreciated that the screws are ordinarily inserted through a sheet of drywall and into a wood or metal anchoring stud. The wood or metal anchoring studs are the partition framing of a building, and the drywall sheets are attached to the anchoring studs using the screws. Numerous screws and other fasteners are typically used in the construction of a building.

Sometimes a drywall installer may insert a screw into the drywall, but the screw is not properly anchored or retained within the anchoring stud. That is, sometimes a drywall installer may not insert a screw in its appropriate location within the anchoring stud. When improperly installed, the screw is only received within the drywall and not the anchoring stud. Due to the consistency of drywall, screws that are driven into a sheet of drywall form a bore or a hole that lacks threads. As a result, it is challenging to extract a screw from drywall, as the threads of the screw are unable to sufficiently grab the drywall. Therefore, it may be difficult to remove a screw from a sheet of drywall by reversing the direction of rotation of a drill used to install the screw.

Those in industry appreciate that improperly installed screws should be removed prior to the application of a finishing compound over the surface of the drywall sheet. This is because a head of the improperly installed screw may shift or protrude, whereas the finishing compound is applied to create a smooth, continuous surface along the drywall. Thus, any improperly installed screws should be removed from the drywall before applying the finishing compound. Drywall installers often use a pry tool, a screwdriver, or even their own fingers to extract a screw from the drywall. If an installer uses his or her hands to remove a screw, sometimes their fingers may be cut, bruised, or otherwise injured. Moreover, such a process is tedious, time-consuming, and may sometimes result in further damage to the drywall as well.

DETAILED DESCRIPTION

Figure 1:
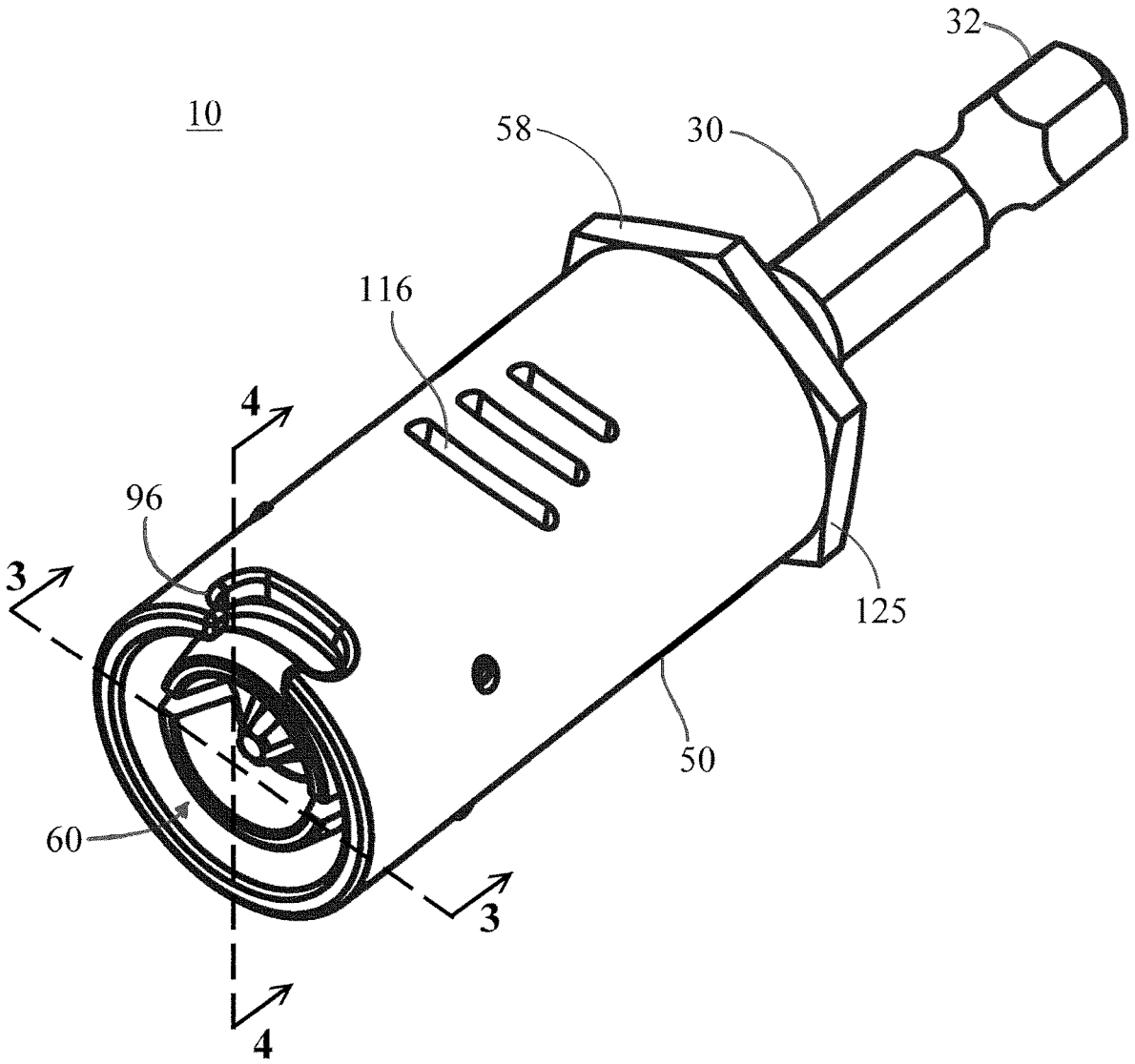
FIG. 1 is a perspective view of the disclosed fastener device.

The following detailed description will illustrate the general principles of the invention, examples of which are additionally illustrated in the accompanying drawings. In the drawings, like reference numbers indicate identical or functionally similar elements.

Figure 2:
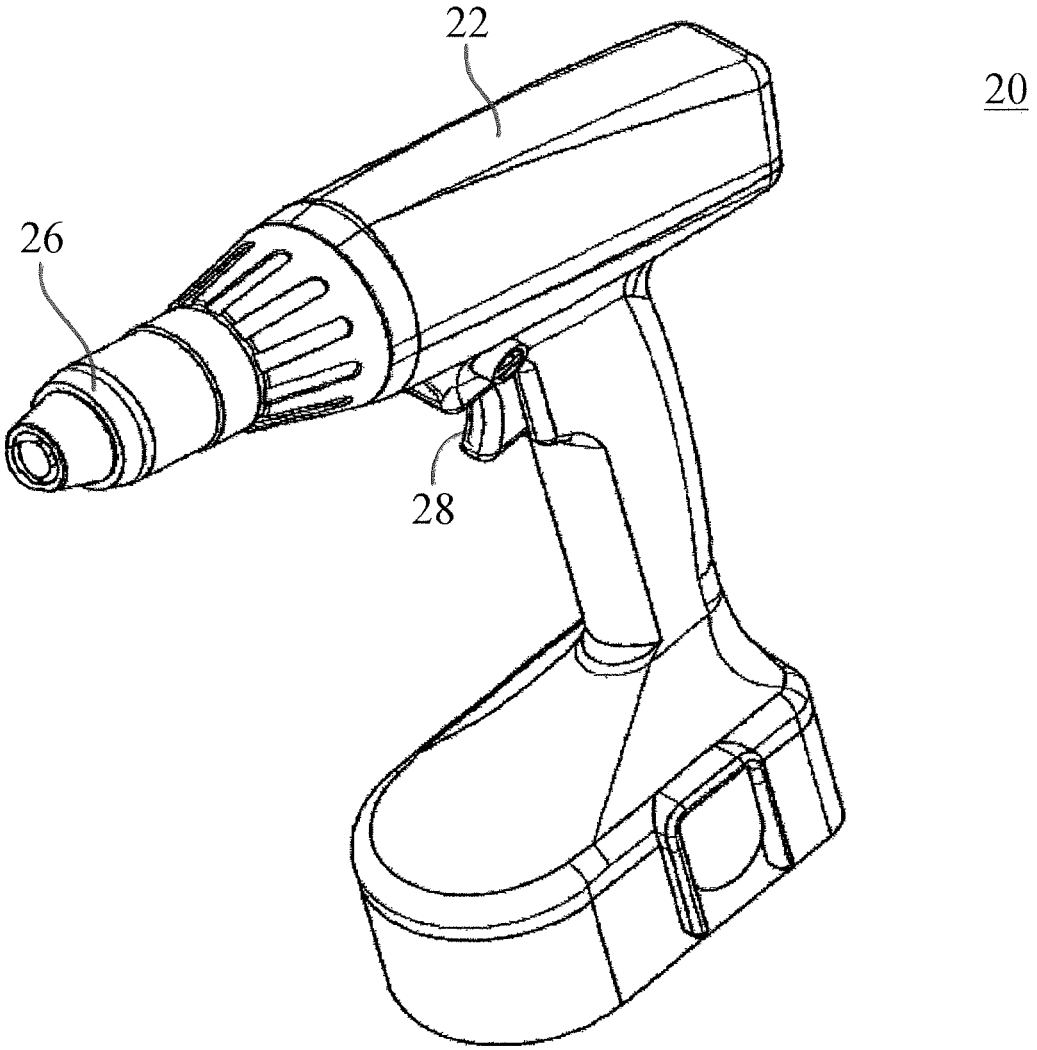
FIG. 2 is an illustration of an electrically powered drive tool that includes a housing containing various electromagnetic components used to drive a rotating chuck.

FIG. 1 is an exemplary illustration of the disclosed fastener device 10. FIG. 2 is an illustration of an electrically powered drive tool 20 that includes a housing 22 containing various electromagnetic components used to drive a rotating chuck 26. The electrically powered drive tool 20 may also include a switch 28 that is a button or trigger. Those of ordinary skill in the art will readily appreciate that in some embodiments the switch may be depressed in incremental amounts in order to adjust the rotational speed of the chuck 26, and that the rotational direction of the chuck 26 may also be reversed. Referring to both FIGS. 1 and 2, the fastener device 10 may be selectively mounted to the chuck 26 of the electrically powered drive tool 20. As explained below, the fastener device 10 may be used to drive fasteners into a surface such as drywall, and may also be used to remove the fasteners that have been improperly installed into the surface.

Continuing to refer to both FIGS. 1 and 2, the chuck 26 of the electrically powered drive tool 20 may be used to retain an attachment shank 30 of the fastener device 10. Specifically, the attachment shank 30 of the fastener device 10 may define a proximal mounting end 32. The proximal mounting end 32 of the attachment shank 30 may be shaped to be received and secured within the chuck 26 (the engagement between the proximal mounting end 32 and the chuck 26 is not illustrated). In the exemplary embodiment as shown in FIG. 1, the proximal mounting end 32 of the fastener device 10 includes a hexagonal profile. However, those of ordinary skill in the art will readily appreciate that the proximal mounting end 32 may include a variety of other shapes.

As explained in greater detail below, the chuck 26 may rotatably drive the fastener device 10, which in turn drives a fastener 40 (seen in FIGS. 11A-11D) into a surface such as, for example, drywall. In some instances, the fastener device 10 may also remove the fastener 40 from the surface of the drywall. In particular, the fastener device 10 may be used to remove a fastener that is improperly installed into the surface. Those of ordinary skill in the art will readily appreciate that when a fastener is improperly installed, the fastener is only received within the drywall and not within an anchoring stud. Thus, a head of the improperly installed fastener may protrude from the surface of the drywall.

Referring to FIGS. 1 and 3-5A, the fastener device 10 may include the attachment shank 30, a hub 50, a distal bit 52, a biasing element 54 a retainer 58, a split cam assembly 60 which may pivot about two roll pins 62, and an elastic ring 64. In the non-limiting embodiment as shown in the figures, the hub 50 may include a generally cylindrical outer surface 66. The hub 50 may define a bore 68 that contains a portion of the attachment shank 30, the bit 52, the biasing element 54 the split cam assembly 60 and roll pins 62, and the elastic ring 64. The attachment shank 30 may define an attachment end 38 that abuts against an attachment end 70 of a separate distal bit 52. The bit 52 includes an opposite end 72 that may be shaped to engage a head 80 of a fastener 40 (FIGS. 11A-11D). The opposite end 72 of the bit 52 may define, for example, a Phillips head bit end, a flat head bit end, or another other type of bit end that is available. It is to be appreciated that the bit 52 may be integral with the attachment shank 30 or separate and removable from the attachment shank 30 so that it be replaced if worn or if another bit with another bit end type is required. The attachment shank 30 includes a radially projecting proximal stop 34, and may include a radially projecting distal stop 36. In the non-limiting embodiment as shown, the attachment shank 30 and the proximal stop 34 are separate components that may be attached to one another by an interference fit or by a joining process such as welding or use of an adhesive, and the distal stop 36 is formed together with the attachment shank 30 as a single, unitary part. In other embodiments, the attachment shank 30 and the proximal stop 34 may be formed together as a single, unitary part, and the attachment shank 30 and the distal stop 36 may be separate components that may be attached to one another by an interference fit or by a joining process such as welding or use of an adhesive. In yet other embodiments, the proximal stop 34 and distal stop 36 may separate elements, or even co-elements of a sleeve that is attached around the attachment shank 30, and attached using one or a combination the aforedescribed methods. In still another embodiment, the attachment shank 30, the proximal stop 34, the distal stop 36, and the bit 52 may all be formed together as a single, unitary part.

As seen in FIGS. 11A-11D, the fastener 40 may define a shank 82, where the shank 82 may be connected to the head 80 of the fastener 40 by a curved or tapered neck. It is to be appreciated that the shank 82 of the fastener 40 may be driven by rotation of the chuck 26 (FIG. 2), via the attachment shank 30 and distal bit 52, into a surface such as drywall and is anchored within an anchoring stud. The fastener 40 may be any type of fastening device such as, but not limited to, a drywall screw, a wood screw, or a machine screw.

Referring to FIGS. 3-5A, the hub 50 may define a proximal end portion 90 and a distal end portion 92, where the bore 68 extends between the proximal and distal end portions 90, 92. One or more fastener removal features 96 may be located along a distal edge 98 of the distal end portion 92 of the hub 50. The fastener removal feature(s) 96 may be shaped to engage with the head 80 of the fastener 40 (FIGS. 11A-11D). The fastener removal feature(s) 96 may be used to pry or remove the fastener 40 from a surface, such as drywall. For example, if a screw is not properly anchored or retained within the wood or anchoring stud, then the fastener removal feature 96 may be used to extract the screw from the drywall.

Figure 5A:
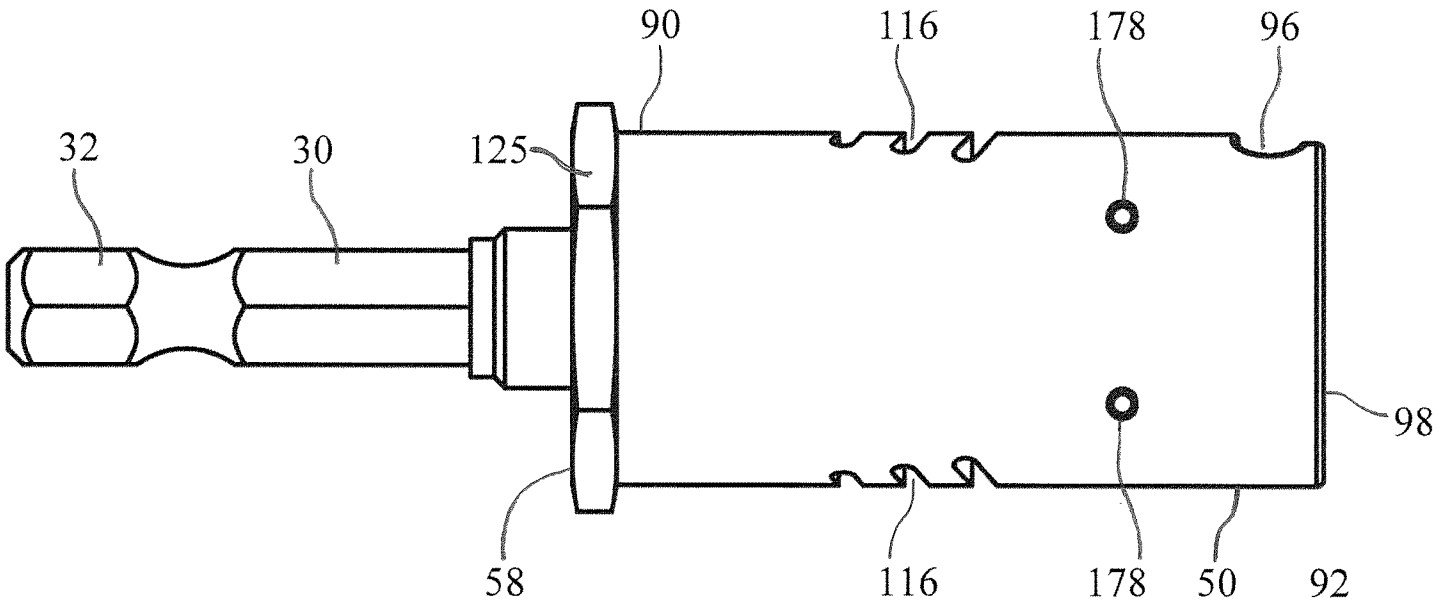
FIG. 5A is a side view of the fastener device shown in FIG. 1
Figure 5B:
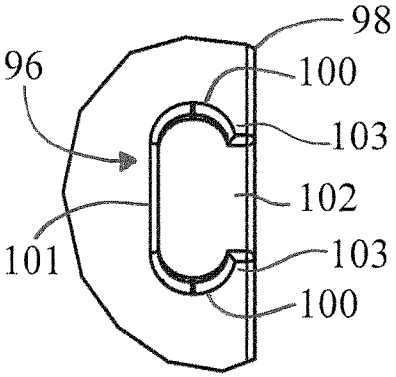
FIG. 5B is a top, detail view of the fastener removal feature shown in FIGS. 1 and 5A.

In the illustrated embodiment, as best seen in FIG. 5B, the fastener removal feature 96 may be a void in the distal end portion 92 of the hub 50 defined by two mutually opposed semi-circular boundary portions 100 that are joined together by a straight boundary portion 101 at one of their mutually opposed ends. The other mutually opposed ends may be separated by a gap 102 so as to define two mutually opposed extraction hooks 103 disposed along the edge 98 of the distal end portion 92. However, it is to be appreciated that the fastener removal feature 96 shown in the figures is merely exemplary in nature, and a number of other shapes approximating the profile of a head 80 of a fastener 40 may be used as well. It should be appreciated that this illustration is exemplary in nature, and other configurations having differing shapes, numbers, and arrangements of fastener removal features 96 in various combinations may be included instead.

Figure 6:
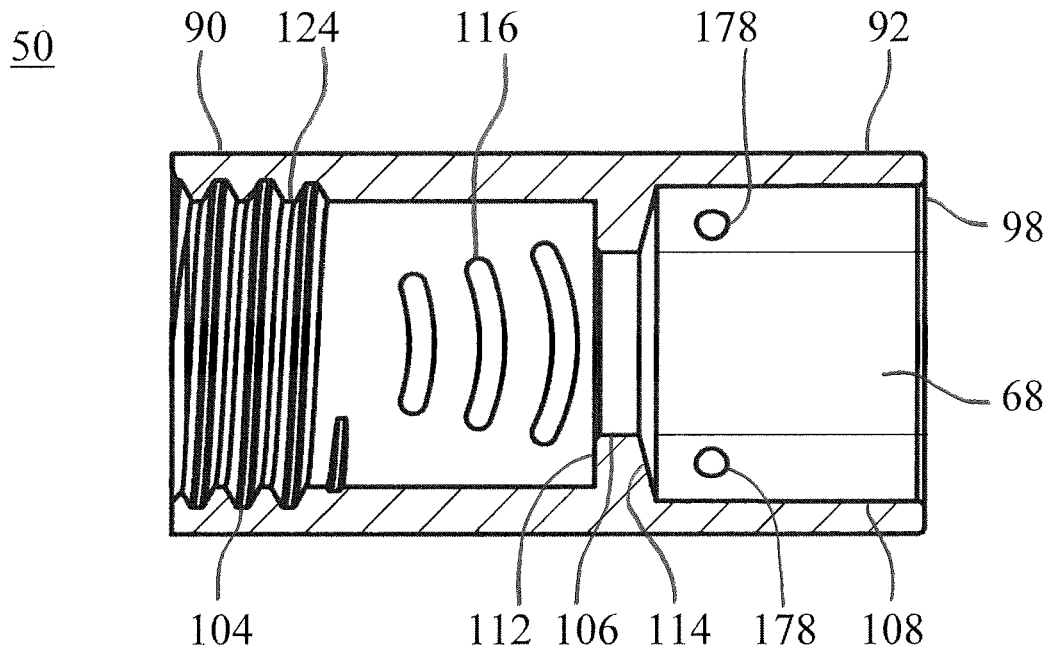
FIG. 6 is a cross-sectioned view of only the hub of the fastener device shown in FIG. 3.

FIG. 6 is a cross-sectioned view of the hub 50. The bore 68 of the hub 50 may include a stepped profile. Specifically, the hub 50 may define a first stepped portion 104, a second stepped portion 106, and a third stepped portion 108 of the bore 68. The first stepped portion 104 may begin at the proximal end portion 90 of the hub 50 and terminate at a radially inward step or chamfer 112 located between the first stepped portion 104 and the second stepped portion 106. The second stepped portion 106 may extend between the inward step or chamfer 112 and a radially outward step or chamfer 114. Finally, the third stepped portion 108 may extend between the outward step or chamfer 114 and the distal end portion 92 of the hub 50. The third stepped portion 108 may include a diameter that is greater than a diameter defined by the first stepped portion 104. The diameter of the first stepped portion 104 may be greater than a diameter defined by the second stepped portion 108. Moreover, the third stepped portion 108 may define a diameter that is greater than the diameter of the second stepped portion 106. The hub 50 may also define a one or more slots 116 radially connecting the exterior of the hub 50 to the bore 68 (multiple slots may be viewed in FIG. 1). The slots 116 may allow an operator to remove debris from the bore 68 of the hub 50.

Referring to FIGS. 3-6, the retainer 58 may be engaged with the proximal end portion 90 of the hub 50. In the illustrated embodiment, the retainer is threadingly engaged with an inner surface 124 of the hub 50 at the first stepped portion 104. It will be appreciated that in other embodiments the retainer 58 may be threadingly engaged with an outer surface of the hub 50, or may be engaged using other structures such as those used in bayonet mounts. The retainer 58 may define a passageway 123 that is shaped to receive the attachment shank 30. As seen in FIGS. 1 and 5A, in one embodiment the retainer 58 may include a polygonally-profiled outer surface 125. The radially projecting proximal stop 34 of the attachment shank 30 may abut against the retainer 58 within the first stepped portion 104. It is to be appreciated that the retainer 58 may secure the attachment shank 30 and the distal bit 52 within the bore 68 of the hub 50. Furthermore, it should also be appreciated that the location of retainer 58 within the first stepped portion 104 of the hub 50 may establish a depth-set distance D through which the attachment shank 30 and the bit 52 may move within the hub 50, and thus the depth to which the opposite end 72 of the bit 52 will drive a head 80 of the fastener 40 into the drywall. The depth-set distance D may be measured between the inward step or chamfer 112 and the radially projecting distal stop 36 of the attachment shank 30, with the distal stop 36 being configured to abut against the inward step or chamfer 112. It will be appreciated that if the retainer 58 is engaged with the proximal end portion 90 of the hub 50 by a threaded connection, the depth-set distance D may be altered by the user by altering the depth of threaded engagement. It should be appreciated, however, the distal stop 36 is an optional feature since contact between a drive tool engaging the proximal mounting end 32 of the attachment shank 30 and the retainer 58 can itself limit the distance through which the attachment shank 30 and the bit 52 may move within the hub 50.

Figure 3:
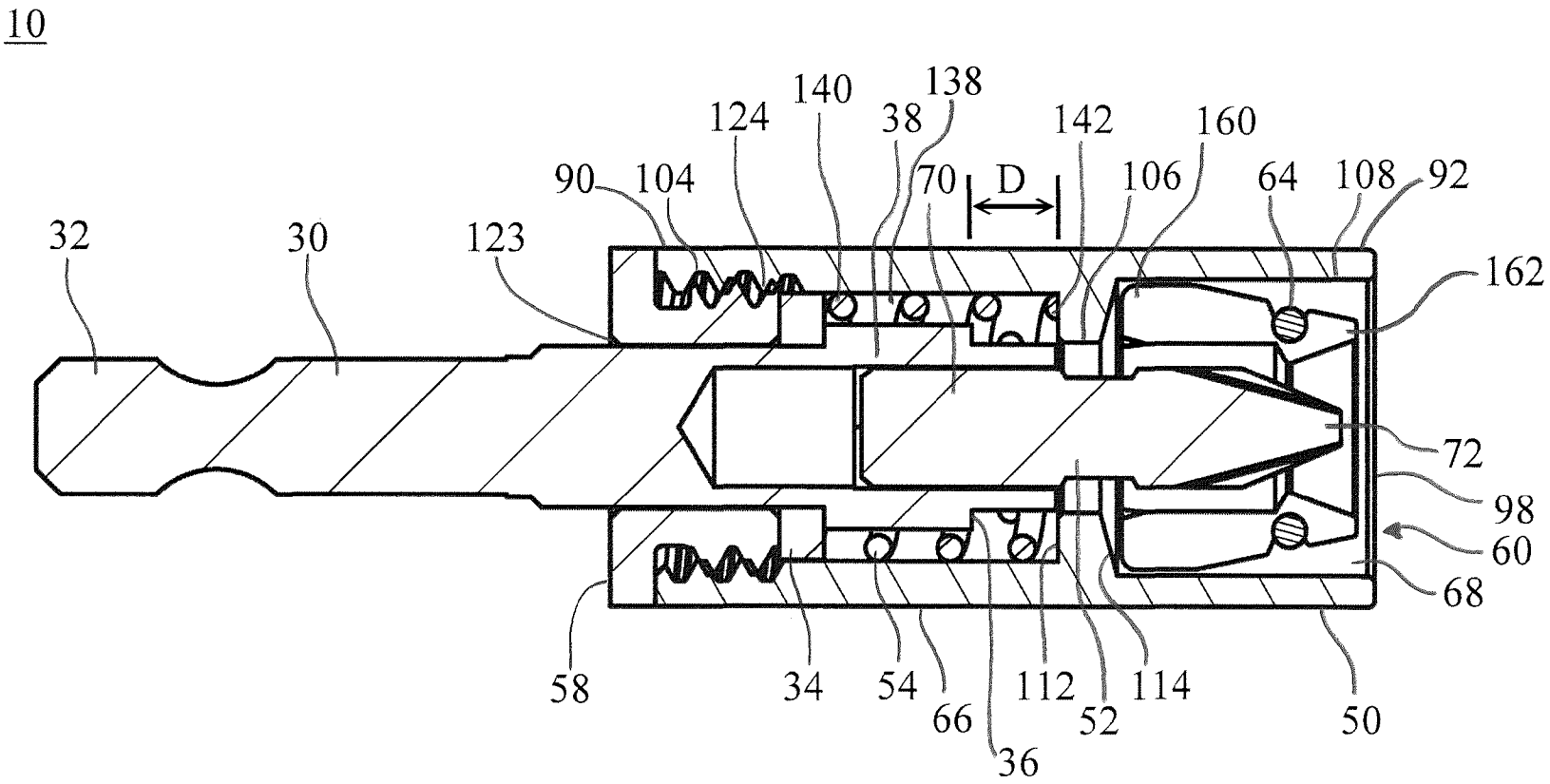
FIG. 3 is a cross-sectioned view of the fastener device illustrated in FIG. 1, taken along Section 3-3 of FIG. 1.
Figure 4:
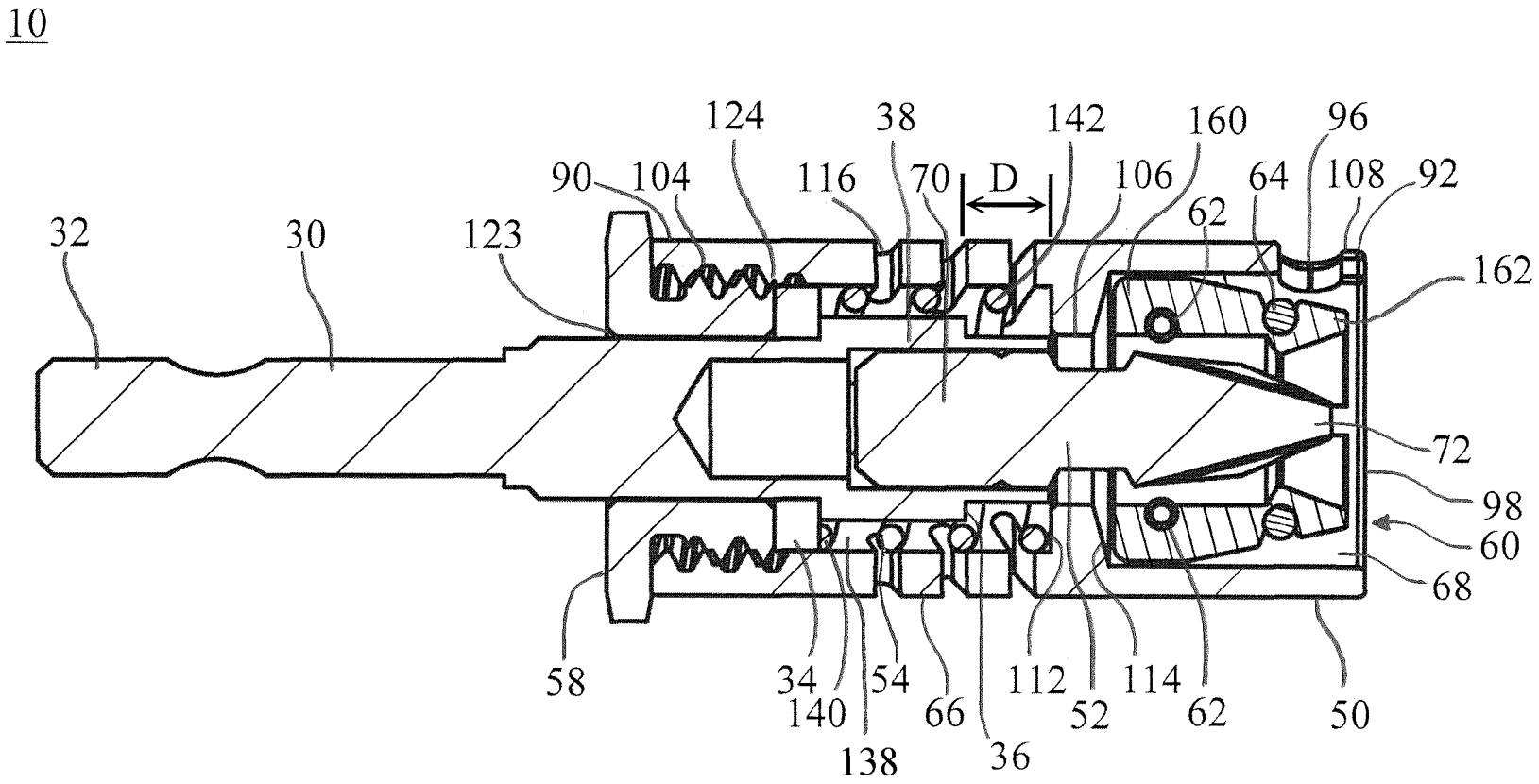
FIG. 4 is a cross-sectioned view of the fastener device illustrated in FIG. 1, taken along Section 4-4 of FIG. 1.
Figure 7:
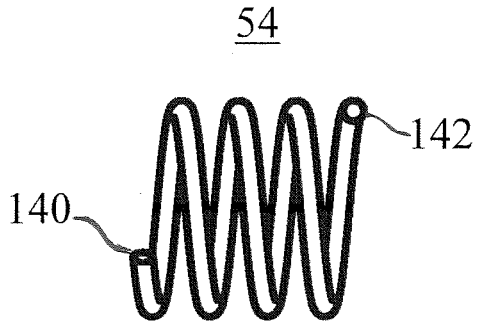
FIG. 7 is a side view of a biasing element for the fastener device shown in FIG. 1.

As seen in FIGS. 3 and 4, the radially projecting proximal stop 34 and the bore 68 of the hub 50 cooperate together to define a cavity 138 that houses the biasing element 54. Referring to FIGS. 3-4 and FIG. 7, the biasing element 54 may include a proximal end portion 140 and a distal end portion 142. The proximal end portion 140 of the biasing element 54 may abut against the proximal stop 34. The distal end portion 142 of the biasing element 54 may abut against the inward step or chamfer 112. In the non-limiting embodiment as shown in the figures, the biasing element 54 is a coil compression spring that exerts a biasing force when compressed. However, it is to be appreciated that the illustrated embodiment is merely exemplary in nature, and that other types of biasing elements may be used as well. The biasing element 54 exerts a biasing force that when unopposed maximizes separation of the proximal stop 34 and, if present, distal stop 36 from the inward step or chamfer 112.

Figure 8:
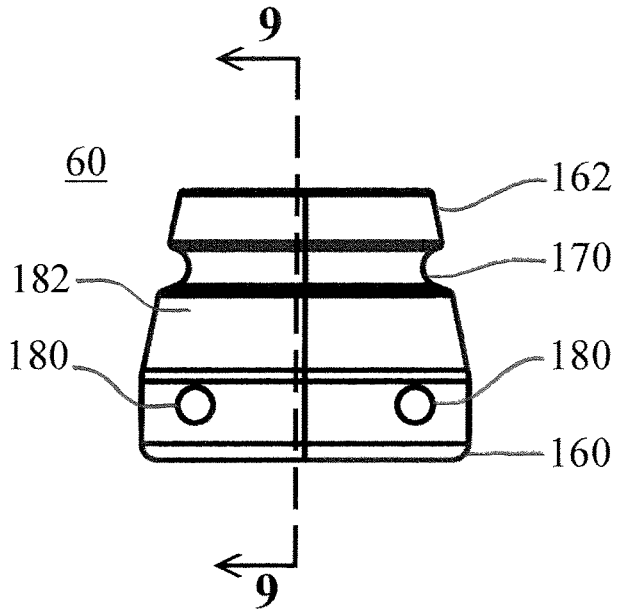
FIG. 8 is a side view of a cam assembly of the fastener device shown in FIG. 1.
Figure 9:
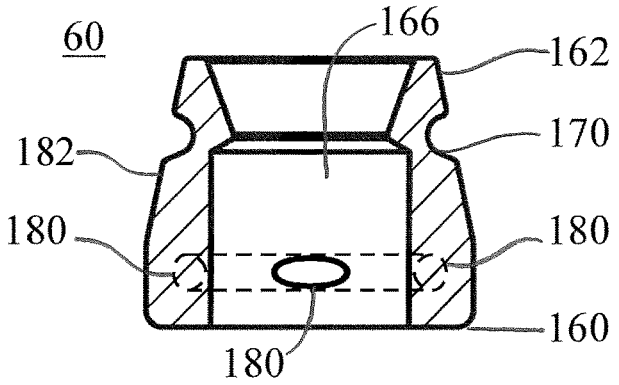
FIG. 9 is a cross-sectioned view of the cam assembly shown in FIG. 8, taken along Section 9-9 of FIG. 8.
Figure 10:
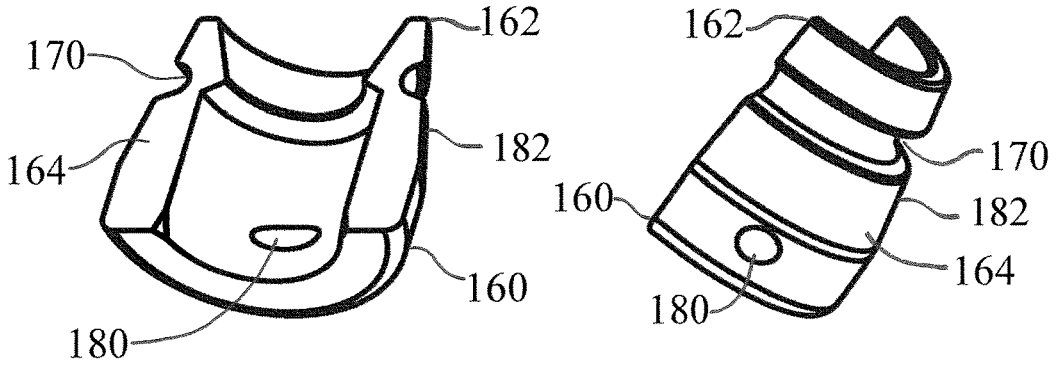
FIG. 10 is a perspective view of two symmetrical half sections of the cam assembly shown in FIG. 8.

FIGS. 8-10 illustrate the split cam assembly 60, which is disposed (with greater separation than shown in FIG. 8) within the third stepped portion 108 of the bore 68 defined by the hub 50. FIG. 8 is a side view of the split cam assembly 60, and FIG. 9 is a cross-sectioned view of the split cam assembly 60 taken along section line 9-9 in FIG. 8. The split cam assembly 60 may be received within the third stepped portion 108 defined by the hub 50. The split cam assembly 60 may comprise two symmetrical half sections 164, which are visible in FIG. 10. The split cam assembly 60 includes a proximal end portion 160 and a distal end portion 162, and defines a central cavity or bore 166 that extends between the proximal and distal end portions 160, 162. The split cam assembly 60 may include an outermost surface 182 having an inwardly tapered profile, where the proximal end portion 160 defines a diameter that is greater than a diameter defined by the distal end portion 162. The outermost surface 182 of split cam assembly 60 may include an annular recess 170 that is positioned adjacent to the distal end portion 162 of the split cam assembly 60. The annular recess 170 of the split cam assembly 60 may be shaped to receive the elastic ring 64 (seen in FIGS. 3 and 4), which may be an O-ring, an annular coil spring, or other annular elastic component. Referring to FIGS. 3-4 and 8-9, the split cam assembly 60 may also define two through bores 180 arranged cross-wise to the central cavity or bore 166, where each through bore 180 may be shaped to receive one of the two roll pins 62. In other embodiments, the split cam assembly 60 may define four blind bores, or a combination of blind and through bores, that each receive one of a plurality of roll pins 62. In yet other embodiments, the split cam assembly 60 may include integral pivot pins in place of separate roll pins 62 and blind or through bores.

Referring to FIGS. 3-5, the hub 50 may define two pairs of mutually opposed apertures 178. However, only one of each pair of apertures 178 is visible in FIG. 5. Each pair of mutually opposed apertures 178 may be shaped to receive and secure a corresponding one of the two roll pins 62. In other embodiments, similar apertures 178 may be shaped to receive and secure the aforementioned integral pivot pins.

Figure 11A:
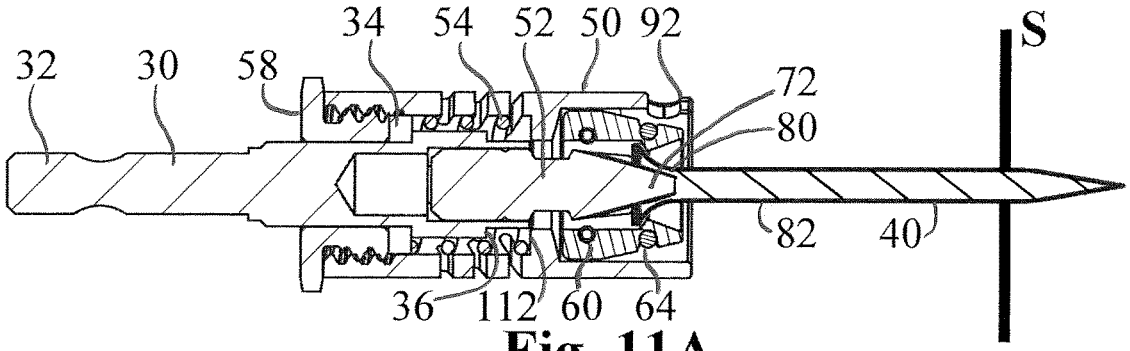
FIGS. 11A-11D are cross-sectioned views of the fastener device as shown in FIG. 4 during various stages of driving a fastener.
Figure 11B:
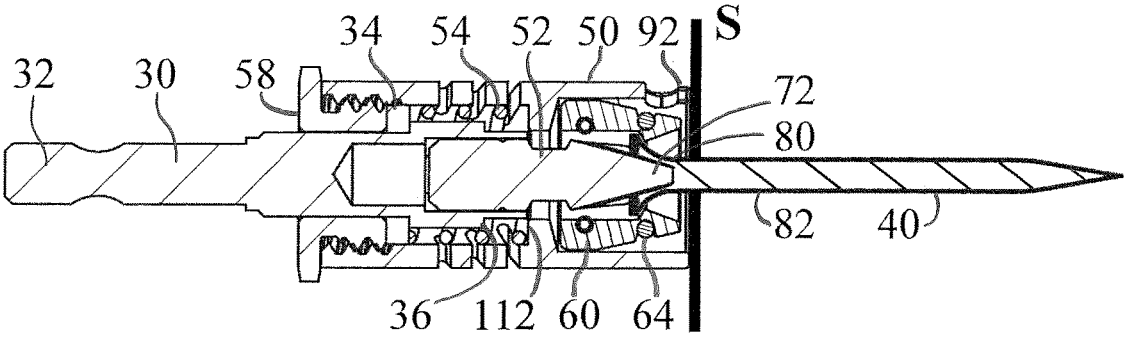

FIGS. 11A-11D are cross-sectioned views of the fastener device 10 during various stages of driving the fastener 40. Referring to FIG. 11A, the elastic ring 64 is secured within the annular recess 170 of the split cam assembly 60 (FIGS. 8-10), and exerts a compressive force against the two symmetrical half sections 164 of the split cam assembly 60. Specifically, the elastic ring 64 biases the two symmetrical half sections 164 of the split cam assembly 60 together at their respective distal end portions 162 in a closed configuration for engaging and retaining the head of the fastener. As explained in greater detail below and as seen in FIGS. 11A-11D, as the fastener 40 is driven into a surface, the head 80 of the fastener 40 may urge the respective distal end portions 162 of the split cam assembly 60 away from one another as the half sections 164 of the split cam assembly 60 pivot to release the head from engagement with the assembly.

FIG. 11A is an illustration of the fastener device 10 at a starting position, before the fastener 40 is driven into a surface S. When the fastener device 10 is in the starting position, the head 80 of the fastener 80 may be secured and retained within the bore 166 of the split cam assembly 60, where the inner surface of the bore 166 may contact the head 80 of the fastener 40. The elastic ring 64 may exert a compressive force against the respective distal end portions 162 of the symmetrical half sections 164 of the split cam assembly 60 to bias them together. When the fastener device 10 is at the starting position, the distal end portions 162 of the split cam assembly 60 may not contact the inner surface 124 of the hub 50.

Figure 11C:
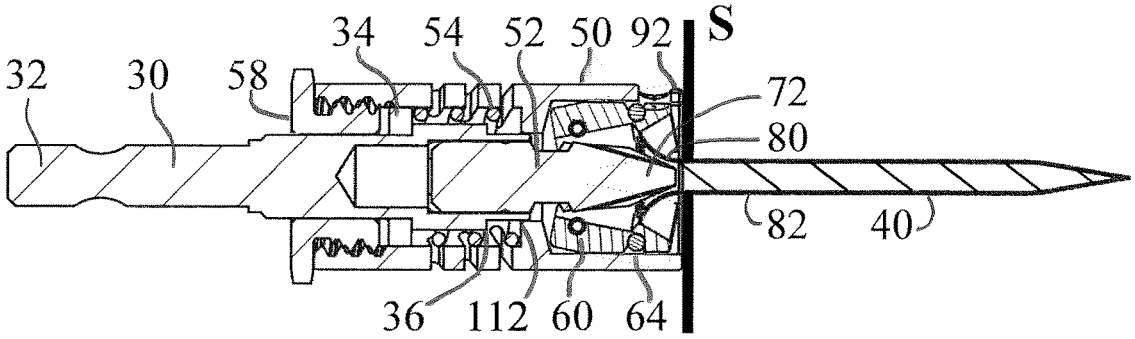
Figure 11D:
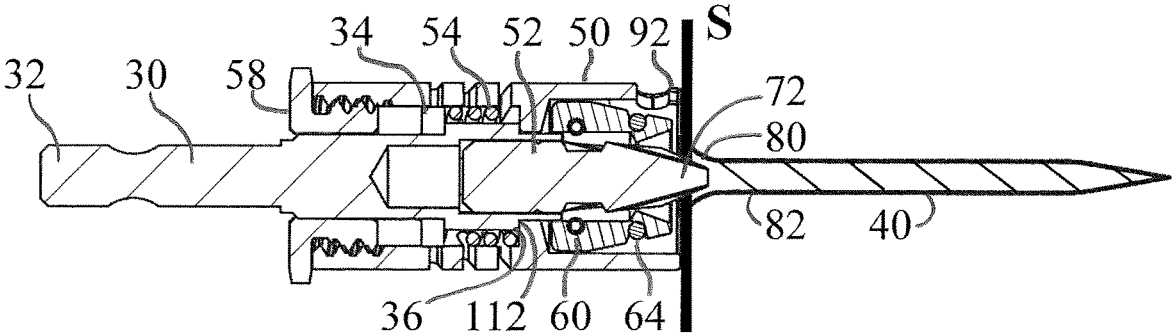

An operator may actuate the fastener device 10 from the starting position by operating an electrically powered drive tool 20 (FIG. 2), and exerting a force that is towards the head 80 of the fastener 40. Upon contact of the distal end portion 92 of the hub 50 with a surface S (FIG. 11B), the reaction force may overcome the biasing force exerted by the biasing element 54 against the proximal stop 34, thereby causing the biasing element 54 to compress. As the biasing member 54 compresses, the attachment shank 30 and the distal bit 52 may travel within the bore 68 of the hub 50 in a direction towards the fastener 40, which is seen in FIGS. 11C-11D. The attachment shank 30 and the bit 52 may continue to travel within the bore 68 of the hub 50 until the distal stop 36 of the attachment shank 30 abuts or otherwise makes contact with the inward step or chamfer 112 (seen in FIG. 11D).

More specifically, as the proximal mounting end 32 of the attachment shank is advanced toward the hub 50, and the attachment shank 30 and distal bit 52 advance within the hub 50 in a direction towards the fastener 40, this in turn causes the opposite end 72 of the bit 52 to advance toward the distal end portion 92 of the hub 50, i.e., in the same direction. As the opposite end 72 of the bit 52 is advanced within the hub 50, this movement pushes or urges the head 80 of the fastener 40 out of the bore 166 of the split cam assembly 60. Movement of the head 80 of the fastener 40 may overcome the compressive force exerted by the elastic ring 64 against the respective distal end portions 162 of the symmetrical half sections 164 of the split cam assembly 60. Thus, the half sections 164 of the split cam assembly 60 may both pivot into the position seen in FIG. 11C. As the opposite end 72 of the bit 52 continues to be advanced within the hub 50, this movement pushes or urges the head 80 of the fastener 40 beyond the distal end portion 162 of the split cam assembly 60, and the half sections 164 of the split cam assembly 60 may both pivot back into the position seen in FIG. 11D around the usually smaller opposite end 72 of the bit 52. The distal stop 36, if present, may abut against the inward step or chamfer 112, whereupon the fastener device 10 is at an end position, and the fastener 40 has been driven into the surface S.

It will be appreciated that the attachment shank 30, the hub 50, the bit 52 (if separate), the biasing element 54, the retainer 58, the split cam assembly 60, the roll pins 62 (if present), the elastic ring 64. and the other above-described components may be manufactured from any suitable materials, including, e.g., polymer resins and fiber-reinforced polymer resins such as nylon, metals and alloys such as aluminum or steel, and other suitable materials, and that the various individual components may be manufactured from various different materials as needed. While the forms of apparatus and methods herein described constitute preferred embodiments of this invention, it is to be understood that the invention is not limited to these precise forms of apparatus and methods, and the changes may be made therein without departing from the scope of the invention.

What is claimed is:

1. A fastener device, comprising:

a hub defining a bore extending between a proximal end portion and a distal end portion, the bore having a proximal portion extending from the proximal end portion to an inward step or chamfer, a medial portion, and a distal portion extending from an outward step or chamfer to the distal end portion;

an attachment shank including a proximal stop and distal bit received within the bore;

a retainer releasably engagable with the proximal end portion of the hub, the retainer defining a passageway for a proximal mounting end of the attachment shank;

a biasing element disposed around the attachment shank, within the proximal portion of the bore, between the proximal stop of the attachment shank and the inward step or chamfer of the bore; and a split cam assembly disposed within the distal portion of the bore, the split cam assembly defining a central cavity or bore for the selective retention of a head of a fastener, the split cam assembly being biased toward a closed configuration for engaging and retaining the head of the fastener, and being piovtable toward an open configuration for releasing the head of the fastener, wherein distal advancement of the attachment shank and distal bit within the bore, against the head of the fastener, causes release of the head of the fastener from the split cam assembly.

2. The fastener device of claim 1, wherein the hub defines one or more slots radially connecting the exterior of the hub to the bore.

3. The fastener device of claim 1, wherein the proximal stop is formed as a separate part and attached to the attachment shank.

4. The fastener device of claim 1, wherein the distal bit is a separate and removable bit, and the attachment shank defines an attachment end that abuts against an attachment end of the separate and removable bit.

5. The fastener device of claim 1, wherein the attachment shank includes a distal stop disposed within the proximal portion of the bore and configured to abut against the inward step or chamfer.

6. The fastener device of claim 5, wherein the distal stop is formed as an integral and unitary part of the attachment shank.

7. The fastener device of claim 5, wherein the retainer is adjustable to establish a depth-set distance through which the attachment shank and the bit may move within the hub.

8. The fastener device of claim 7, wherein the retainer is threadingly engaged with the hub.

9. The fastener device of claim 1, wherein the biasing element is a coil compression spring.

10. The fastener device of claim 1, wherein the hub includes two pairs of mutually opposed apertures, and the split cam assembly includes two halves with each half engaging one of the two pairs of mutually opposed apertures.

11. The fastener device of claim 10, wherein each half includes integral pivot pins received within a respective one of the two pairs of mutually opposed apertures.

12. The fastener device of claim 10, wherein each half includes a through bore arranged cross-wise to the central cavity or bore of the split cam assembly and a roll pin secured through the through bore and a respective one of the two pairs of mutually opposed apertures.

13. The fastener device of claim 10, wherein each half includes two blind bores arranged cross-wise to the central cavity or bore of the split cam assembly and a pins secured through the blind bores and apertures of a respective one of the two pairs of mutually opposed apertures.

14. The fastener device of claim 1, wherein an outermost surface of the split cam assembly includes an annular recess that is positioned adjacent to a distal end portion of the split cam assembly, and an elastic ring is disposed within the annular recess to bias the split cam assembly toward the closed configuration.

15. The fastener device of claim 1, wherein the distal end portion of the hub includes a fastener removal feature, the fastener removal feature comprising a void in distal end portion of the hub adjoining a distal edge of the distal end portion of the hub that approximates a profile of the head of the fastener.

16. The fastener device of claim 15, wherein the fastener removal feature comprises mutually opposed extraction hooks disposed along the distal edge.

17. The fastener device of claim 16, wherein the fastener removal feature comprises two mutually opposed semi-circular boundary portions that are joined together by a straight boundary portion at one of the mutually opposed semi-circular boundary portions' mutually opposed ends, with the other of the mutually opposed semi-circular boundary portions' mutually opposed ends separated by a gap so as to define two mutually opposed extraction hooks disposed along the distal edge.

* * * * *